US006982014B1

(12) United States Patent
Muneno et al.

(10) Patent No.: US 6,982,014 B1
(45) Date of Patent: Jan. 3, 2006

(54) EXPLOSIVE COMPOSITION FOR FIREWORKS AND METHOD FOR MANUFACTURING THE SAME

(75) Inventors: Yoshiyuki Muneno, Yamaguchi (JP); Toshio Matsuzawa, Yamaguchi (JP)

(73) Assignee: Nippon Kayaku Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/807,319

(22) PCT Filed: Oct. 20, 1999

(86) PCT No.: PCT/JP99/05783

§ 371 (c)(1),
(2), (4) Date: Jun. 4, 2001

(87) PCT Pub. No.: WO00/23401

PCT Pub. Date: Apr. 27, 2000

(30) Foreign Application Priority Data

Oct. 22, 1998 (JP) ..... 10/300540

(51) Int. Cl.
*C06B 45/10* (2006.01)

(52) U.S. Cl. ..... 149/19.8

(58) Field of Classification Search ..... 149/19.8
See application file for complete search history.

(56) References Cited

U.S. PATENT DOCUMENTS

| | | | | | |
|---|---|---|---|---|---|
| 3,419,444 | A | * | 12/1968 | Minnick | 149/89 |
| 3,616,759 | A | | 11/1971 | Meyr et al. | 102/100 |
| 3,715,248 | A | * | 2/1973 | Swotinsky et al. | 149/19.8 |
| 3,754,877 | A | * | 8/1973 | Klug | 149/108.6 |
| 3,951,704 | A | * | 4/1976 | Stack | 149/19.8 |
| 4,008,110 | A | * | 2/1977 | Machacek | 149/89 |
| 4,078,954 | A | * | 3/1978 | Bernardy | 149/19.8 |
| 4,138,282 | A | * | 2/1979 | Goddard et al. | 149/19.8 |
| 4,263,051 | A | * | 4/1981 | Crawford et al. | 106/484 |
| 4,341,573 | A | * | 7/1982 | Donoho | 149/42 |
| 4,768,439 | A | * | 9/1988 | Singer et al. | 102/336 |
| 5,218,166 | A | * | 6/1993 | Schumacher | 149/19.8 |
| 5,438,824 | A | * | 8/1995 | Asaoka et al. | 60/251 |

FOREIGN PATENT DOCUMENTS

| | | |
|---|---|---|
| EP | 0 067 560 | 12/1982 |
| JP | 55-15942 | 2/1980 |
| JP | 56-22698 | 2/1981 |
| JP | 57-188491 | 11/1982 |
| JP | 7-190696 | 7/1995 |
| JP | 8-2990 | 1/1996 |

OTHER PUBLICATIONS

WPI Acc. No. 97-163554/199715 "Firework compsn.-contains nitro-cellulose, plasticiser, oxidiser, metal combustible, and additives, processed by extrusion to coaxial laminated elements with different colour layers" (Lyuberets Soyuz Res Prodn Assoc)—Abstract & RU, 2064914, A (Oct. 8, 1996). Copy of the International Search Report dated Dec. 21, 1999.

* cited by examiner

*Primary Examiner*—Aileen Felton
(74) *Attorney, Agent, or Firm*—Nields & Lemack

(57) ABSTRACT

A method for preparing a pyrotechnic composition which comprises preparing a composition in a gel form using nitrocellulose and a nitro compound other than nitrocellulose, adding an oxidizing agent, a combustible material and a color rendering agent to the composition, followed by mixing, forming the resultant mixture into a desired shape, and then drying; and a pyrotechnic composition obtainable by using the method. This method can be used for simplifying a production process while maintaining the effect of a star and a lance used in a pyrotechnic composition, particularly in a firework composition.

5 Claims, No Drawings

EXPLOSIVE COMPOSITION FOR FIREWORKS AND METHOD FOR MANUFACTURING THE SAME

FIELD OF THE INVENTION

The present invention relates to pyrotechnic compositions widely used in propellants, illuminating compositions, colored flame compositions, colored smoke compositions, ignition compositions and the like. More particularly, it relates to the pyrotechnic compositions capable of creating many effects such as color, motion, light, smoke, noise and the like as well as method for preparation thereof.

BACKGROUND OF THE INVENTION

A pyrotechnic composition is generally prepared by adding a fuel to an oxidizing agent. The fuel reacts with oxygen derived from the oxidizing agent to produce an oxidized product together with heat. Taking advantage of this heat, many effects such as color, motion, light, smoke, noise and the like can be created.

The pyrotechnic composition is typically employed as firework composition wherein a flame reaction plays the role. For example, to make a red color, a strontium salt is used as a color producing agent. Although strontium nitrate had been used, strontium carbonate is mainly used at present since it is very stable and gives a beautiful color. Similarly, to make a green color, barium nitrate is typically used. To make a yellow color, sodium oxalate and calcium carbonate are typically used. To create a blue color, pairs green and copper oxide are typically used. To make a purple color, a mixture of strontium carbonate and copper oxide is typically used. To make a white color, aluminum is typically used.

Japanese launching fireworks are generally "Chrysanthemum type round shells" blooming in circle. In the round shell, "stars" are arranged inside around a package such that the stars burn all together and also go out all together. As the star, a spherical star called as "a multi-coated star" is used. The spherical star is prepared by directly putting in a rolling caldron such as a concrete mixer a round cereal such as a foxtail millet seed and a rape seed or shot which is used as a core, adding a mixture comprising an oxidizing agent, a fuel, a color producing agent and a paste together with water while rotating the rolling caldron to grow a star until a layer resulting from the mixture having a suitable thickness is adhered to the core, and spreading over a drying table to be dried. After drying well, the star is charged in the rolling caldron again to further grow. This work is repeated until the star having a desired size is obtained. For example, in order to obtain a star of 20.5 mm in diameter used for a 10-gou (=30 cm) aerial shell, the above work is repeated about 35 times and it takes at least about-17 days to finish.

In a fireworks display, exhibition fireworks are indispensable. The exhibition firework includes lances and quick matches. "Lance" comprises a paper pipe in which a mixture of an oxidizing agent, a color producing agent and a fuel is filled, such as a "susuki (eulalia)" and a "torch" of toy fireworks. In order to make six colors, i.e. red, green, yellow, blue, purple and white (silver) colors, suitable color producing agents are used.

Operations for the manufacture of stars and lances are laborious. Especially in the manufacture of stars, it takes a considerable time to finish as described above, which lowers the productivity. In the manufacture of lances, the operation of uniformly filling a powder in a paper pipe is laborious.

SUMMARY OF THE INVENTION

The present inventors investigated hardly to develop a pyrotechnic composition, especially useful as a firework composition which can be prepared while simplifying a laborious process for manufacturing stars and lances and has a display effect similar to that of the prior stars and lances. As a result, the inventors found that a pyrotechnic composition comprising specific chemicals can attain the above object. Based on this finding, the present invention was competed.

That is, the present invention relates to:

(1) a pyrotechnic composition comprising nitrocellulose, an oxidizing agent, a fuel and a color producing agent as main components;

(2) a pyrotechnic composition prepared by mixing nitrocellulose and a nitro compound other than nitrocellulose to prepare a composition in a gel form, mixing an oxidizing agent, a fuel and a color producing agent to the composition and then drying;

(3) a pyrotechnic composition as defined in (2) wherein the composition in the gel form comprises 3 to 40% by weight of nitrocellulose and 97 to 60% by weight of the nitro compound other than nitrocellulose;

(4) a pyrotechnic composition as defined in any one of (1) to (3) wherein the content of nitrocellulose in the pyrotechnic composition is 0.6 to 12% by weight;

(5) a pyrotechnic composition as defined in any one of (1) to (4) wherein the contents of the oxidizing agent, the fuel and the color producing agent are 40 to 60% by weight, 10 to 25% by weight and 15 to 50% by weight, respectively;

(6) a pyrotechnic composition as defined in any one of (1) to (5) which is a star or a lance of fireworks; and (7) a method for the preparation of a pyrotechnic composition comprising mixing nitrocellulose and a nitro compound other than nitrocellulose to prepare a composition in a gel form, mixing an oxidizing agent, a fuel and a color producing agent to the composition and then drying;

(8) a method for the preparation of a pyrotechnic composition as defined in (7) wherein the composition in the gel form comprises 3 to 40% by weight of nitrocellulose and 97 to 60% by weight of the nitro compound other than nitrocellulose;

(9) a method for the preparation of a pyrotechnic composition as defined in (7) or (8) wherein the amount of the composition in the gel form is 10 to 30% by weight and the total amount of the oxidizing agent, the fuel and the color producing agent is 90 to 70% by weight;

(10) a method for the preparation of a pyrotechnic composition as defined in any one of (7) to (9) wherein the nitro compound other than nitrocellulose is nitroalkane;

(11) a method for the preparation of a pyrotechnic composition as defined in (10) wherein the nitroalkane is one or more selected from the group consisting of nitromethane, nitroethane and nitropropane;

(12) a method for the preparation of a pyrotechnic composition as defined in any one of (7) to (11) wherein the pyrotechnic composition is a star or a lance of fireworks.

EMBODIMENT OF THE INVENTION

The present invention will be described in more detail.

As nitrocellulose used in the pyrotechnic composition of the present invention, nitrocellulose having any type called as a gun cotton, a collodion cotton or a friable cotton is usable. Nitrocellulose for dynamite included in the collodion cotton is also usable. Nitrocellulose for dynamite containing 11 to 12.5% by weight of nitrogen may be used in a dry state. Water may be added thereto for safety. The use of nitrocellulose containing 25 to 30% by weight of water is preferable for safety. The content of nitrocellulose in the pyrotechnic composition is 0.6 to 12% by weight, preferably 1 to 6% by weight.

Since nitrocellulose acts as a binder in the pyrotechnic composition of the present invention, the use of nitrocellulose is very important for obtaining the easily preparable pyrotechnic composition of the present invention.

As the nitro compound other than nitrocellulose used in the preparation of the pyrotechnic composition of the present invention, a nitro compound forming a composition in a gel form upon mixing with nitrocellulose is preferable. Usually, an aliphatic nitro compound or an aromatic nitro compound is used. Example of the usable aliphatic nitro compound includes nitroalkanes such as nitromethane, nitroethane, nitropropane, nitrobutane and the like. Example of the usable aromatic nitro compound includes nitrobenzene, nitrotoluene, dinitrobenzene, dinitrotoluene and the like. The nitro compound other than nitrocellulose may be used singly or in combination. Among them, the nitroalkanes such as nitromethane, nitroethane, nitropropane, nitrobutane and the like are preferable. Especially, nitromethane, nitroethane and nitropropane are preferable. When the nitro compound other than nitrocellulose is solid at ordinary temperature, it is preferably used in the molten state.

As the oxidizing agent used in the pyrotechnic composition of the present invention, the use of an oxygen-rich ionic solid releasing oxygen gas when decomposed at moderate to high temperature is generally preferable. Any agent can be used as long as it is reacted under a neutral condition even if it absorbs moisture, it is stable in a wide temperature range and it is easily decomposed at high temperature to release oxygen. The oxidizing agent having an anion such as nitrate, chlorate, perchlorate, chromate, oxide, dichromate ions is preferable. As a cation in the oxidizing agent, alkali metal such as lithium, sodium and potassium, alkaline earth metal such as calcium, strontium and barium, and ammonium ions are preferable. Examples of the usable oxidizing agent include ammonium nitrate, potassium nitrate, sodium nitrate, barium nitrate, strontium nitrate, ammonium perchlorate, potassium perchlorate, potassium chlorate, barium chlorate and the like. The oxidizing agent may be used singly or in combination.

The content of the oxidizing agent in the pyrotechnic composition of the present invention is generally 30 to 70% by weight, preferably 40 to 60% by weight based on the total pyrotechnic composition.

As the fuel used in the pyrotechnic composition of the present invention, the use of a material reacting with oxygen derived from the oxidizing agent to produce an oxidized product together with heat is preferable. Taking advantage of the heat produced, various effects such as color, motion, light, smoke and noise are created. Many materials capable of being involved in a combustion can be used as the fuel, but the fuel is suitably selected depending on a variety of factors such as an amount of heat output, a rate of heat release, an ease of availability, a stability in the composition, a gas yield and the like. The fuel usable in the present invention is roughly classified into three types, i.e. metals, non-metallic elements and organic compounds.

As the metallic fuel, aluminum, magnesium, magnalium, titanium, iron filings and a mixture thereof can be used. As the non-metallic fuel, sulfur, boron, silicon, phosphor and a mixture thereof can be used. As the organic fuel, shellac, red gum, charcoal, wood flour, carbohydrate, natural phenolic resin (for example, VINZOL™, Combustion agent BL manufactured by RikaHercules), chlorinated rubber (for example, ADEKAPRENE™ D-1 manufactured by Asahi Denka Kogyo), phenolic resin (for example, RESITOP™ PGA-2400 manufactured by Gun-ei Chemical Industrial Co. Ltd.), pine tar pitch and a mixture thereof can be used. Each of the metallic fuel, the non-metallic fuel and the organic fuel may be used singly or in combination.

The content of the fuel used in the pyrotechnic composition of the present invention is determined depending on the aforementioned factors. It is preferably 5 to 40% by weight, more preferably 10 to 25% by weight in the composition.

As the color producing agent used in the pyrotechnic composition of the present invention, any substance showing a flame reaction after burned can be used. As a red color producing agent, strontium salts such as strontium carbonate and the like are preferably used. As a green color producing agent, barium salts such as barium nitrate and the like are preferably used. As a blue color producing agent, copper salts such as copper oxide, basic copper carbonate, copper sulfate and the like are preferably used. As a purple color producing agent, a mixture of strontium carbonate and copper oxide is preferably used. As a yellow color producing agent, sodium salts such as sodium oxalate, cryolite and the like are preferably used. And, the conventional color matching technique by adjusting and mixing several color producing agents so as to obtain a desired color may be employed.

The content of the color producing agent used in the pyrotechnic composition is preferably 5 to 50% by weight, more preferably 15 to 50% by weight. Although a part of the nitrates such as barium nitrate has also a property of oxidizing agent, an amount of such a nitrate is calculated as the color producing agent herein. The pyrotechnic composition of the present invention comprises 30 to 70% by weight (preferably 40 to 60% by weight) of the oxidizing agent, 5 to 40% by weight (preferably 10 to 25% by weight) of the fuel and 5 to 50% by weight (preferably 15 to 50% by weight) of the color producing agent, as described above.

The pyrotechnic composition of the present invention is prepared by mixing nitrocellulose, the oxidizing agent, the fuel and the color producing agent, adding the nitro compound other than nitrocellulose thereto and then manually mixing it by using a simple stirrer such as a bamboo spatula or the like or mechanically mixing to prepare a plastic-like composition followed by drying.

As described above, the pyrotechnic composition of the present invention can be prepared by merely mixing nitrocellulose, the oxidizing agent, the fuel, the color producing agent and the nitro compound other than nitrocellulose and then drying. However, a method comprising first mixing nitrocellulose and the nitro compound other than nitrocellulose to prepare a composition in a gel form, adding the oxidizing agent, the fuel and the color producing agent to the composition in the gel form, if necessary forming into a desired shape and then drying is more preferable.

Thus, for the preparation of the pyrotechnic composition of the present invention, nitrocellulose and the nitro compound other than nitrocellulose are charged into a container and mixed manually using a simple stirrer or mechanically using a mixer such as a kneader to prepare a composition in a gel form, to which the oxidizing agent, the fuel and the color producing agent are added and uniformly mixed to prepare a plastic-like mixture. In this connection, the oxidizing agent, the fuel and the color producing agent may be mixed followed by mixing the resultant mixture with the composition in the gel form. Alternatively, they may be added successively to the composition in the gel form. Any mixer other than the kneader may be used as long as it has both stirring and mixing functions. The ratio of the total amount of the oxidizing agent, the fuel and the color producing agent to the gel composition is preferably 10 to 30% by weight: 90 to 70% by weight.

The composition in the gel form is generally prepared by mixing 3 to 40% by weight (preferably 15 to 25% by weight) of nitrocellulose and 97 to 60% by weight (preferably 85 to 75% by weight) of the nitro compound other than nitrocellulose.

As obvious for those skilled in the art, when the pyrotechnic composition of the present invention is applied to stars, it is shaped into a sphere and dried to be cured, thereby a star having a sufficient strength can be obtained. When the pyrotechnic composition of the present invention is applied to lances, it is shaped into a bar by extruding through a die in a container, cut into a predetermined length and dried to be cured. Or, after the extrusion into a bar, the composition may be dried and cured. Thereafter, it is wrapped with a paper. Alternatively, a gel may be filled in a paper pipe and then dried. A drying temperature is generally 30 to 70° C., preferably 50 to 60° C. Drying may be conducted under reduced pressure. Since the nitro compound other than nitrocellulose is evaporated via the drying process, the pyrotechnic composition of the present invention contains a minor amount of such a nitro compound.

Since nitrocellulose, the oxidizing agent, the fuel, the color producing agent and the like cannot be evaporated according to the method for the preparation of the present invention, they are present in the proportion originally added when the pyrotechnic composition of the present invention is prepared.

EXAMPLES

The present invention will be described in more detail by referring to the following examples which are not intended to limit the invention.

Example 1

4 Parts by weight of nitrocellulose (nitrocellulose for dynamite, containing 11.9 to 12.2% of nitrogen) and 16 parts by weight of nitrobenzene were mixed to prepare a composition in a gel form. While, 46.4 parts by weight of potassium perchlorate (oxidizing agent), 3.6 parts by weight of hemp coal (fuel), 6.8 parts by weight of VINZOL™ (Combustion agent BL, manufactured by RikaHercules), 6.8 parts by weight of ADEKAPRENE™ D-1(chlorinated rubber, manufactured by Asahi Denka Kogyo) and 2.4 parts by weight of RESITOP™ PGA-2400 (phenolic resin, manufactured by Gun-ei Chemical Industrial Co. Ltd.) (total 19.6 parts by weight) were mixed with 14 parts by weight of copper oxide (color producing agent). The resultant mixture was mixed with the above composition in the gel form, shaped into a sphere, dried in a drier at 50 to 60° C. to be cured. Thus, a blue star for aerial shell having the diameter of 20 mm and comprising the pyrotechnic composition of the present invention was obtained. By igniting, the blue star was confirmed to have an effect of blue flame similar to that of the prior blue star for aerial shell.

Example 2

4 Parts by weight of nitrocellulose as used in Example 1 and 16 parts by weight of nitromethane were mixed at room temperature to prepare a composition in a gel form. While, 44 parts by weight of potassium perchlorate (oxidizing agent), 3.6 parts by weight of hemp coal (fuel), 6.8 parts by weight of VINZOL™ (Combustion agent BL, manufactured by RikaHercules), 6.8 parts by weight of ADEKAPRENE™ D-1 (chlorinated rubber, manufactured by Asahi Denka Kogyo) and 2.8 parts by weight of RESITOP™ PGA-2400 (phenolic resin, manufactured by Gun-ei Chemical Industrial Co. Ltd.) (total 20 parts by weight) were mixed with 16 parts by weight of strontium carbonate (color producing agent). The resultant mixture was mixed with the above composition in the gel form, shaped into a sphere, dried in a drier at 50 to 60° C. to be cured. Thus, a red star for aerial shell having the diameter of 20 mm and comprising the pyrotechnic composition of the present invention was obtained. By igniting, the red star was confirmed to have an effect of red flame similar to that of the prior red star for aerial shell.

Example 3

3.5 Parts by weight of nitrocellulose as used in Example 1 and 14 parts by weight of dinitrotoluene were mixed to prepare a composition in a gel form. While, 40.6 parts by weight of potassium perchlorate (oxidizing agent), 3.2 parts by weight of hemp coal (fuel), 6.0 parts by weight of VINZOL™ (Combustion agent BL, manufactured by Rika-Hercules), 6.0 parts by weight of ADEKAPRENE™ D-1 (chlorinated rubber, manufactured by Asahi Denka Kogyo) and 2.1 parts by weight of RESITOP™ PGA-2400 (phenolic resin, manufactured by Gun-ei Chemical Industrial Co. Ltd.) (total 17.3 parts by weight) were mixed with 24.6 parts by weight of barium nitrate (color producing agent). The resultant mixture was mixed with the above composition in the gel form, shaped into a bar, dried in a drier at 50 to 60° C. to be cured. Thus, a green lance comprising the pyrotechnic composition of the present invention was obtained. By igniting, the green lance was confirmed to have an effect of green flame similar to that of the prior green lance.

Example 4

4 Parts by weight of nitrocellulose as used in Example 1 and 16 parts by weight of 1-nitropropane were mixed to prepare a composition in a gel form. While, 40 parts by weight of potassium perchlorate (oxidizing agent), 3.6 parts by weight of hemp coal (fuel), 6.8 parts by weight of VINZOL™ (Combustion agent BL, manufactured by Rika-Hercules), 6.8 parts by weight of ADEKAPRENE™ D-1 (chlorinated rubber, manufactured by Asahi Denka Kogyo) and 2.8 parts by weight of RESITOP™ PGA-2400 (phenolic resin, manufactured by Gun-ei Chemical Industrial Co. Ltd.) (total 20 parts by weight) were mixed with 20 parts by weight of barium nitrate (color producing agent). The resultant mixture was mixed with the above composition in the gel form, shaped into a sphere, dried in a drier at 50 to 60° C. to be cured. Thus, a green star for aerial shell having the diameter of 20 mm and comprising the pyrotechnic composition of the present invention was obtained. By igniting, the green star was confirmed to have an effect of green flame similar to that of the prior green star for aerial shell.

Example 5

3.5 Parts by weight of nitrocellulose as used in Example 1 and 14 parts by weight of nitroethane were mixed to prepare a composition in a gel form. While, 50.5 parts by weight of potassium perchlorate (oxidizing agent), 2 parts by weight of hemp coal (fuel), 6.6 parts by weight of VINZOL™ (Combustion agent BL, manufactured by Rika-Hercules), 6.6 parts by weight of ADEKAPRENE™ D-1 (chlorinated rubber, manufactured by Asahi Denka Kogyo) and 2.1 parts by weight of RESITOP™ PGA-2400 (phenolic resin, manufactured by Gun-ei Chemical Industrial Co. Ltd.) (total 17.3 parts by weight) were mixed with 14.7 parts by weight of sodium oxalate (color producing agent). The resultant mixture was mixed with the above composition in the gel form, shaped into a sphere, dried in a drier at 50 to 60° C. to be cured. Thus, a yellow star for aerial shell having the diameter of 20 mm and comprising the pyrotechnic composition of the present invention was obtained. By igniting, the yellow star was confirmed to have an effect of yellow flame similar to that of the prior yellow star for aerial shell.

Examples 6 to 9

In Examples 6 and 7, the pyrotechnic compositions stars) having the formulations as shown in following Table were obtained in the same way as described in Example 1.

In Examples 8 and 9, the pyrotechnic compositions (lances) having the formulations as shown in following Table were obtained in the same way as described in Example 3.

TABLE

| chemicals used | | amount (parts by weight) | | | |
|---|---|---|---|---|---|
| | | Ex. 6 | Ex. 7 | Ex. 8 | Ex. 9 |
| nitrocellulose | | 1.2 | 10.0 | 6.8 | 3.5 |
| nitro compound other than nitrocellulose | nitromethane | 15.8 | | | |
| | nitroethane | | | | 16.5 |
| | nitropropane | | | 11.7 | |
| | dinitrotoluene | | 15.5 | | |

TABLE-continued

| chemicals used | | amount (parts by weight) | | | |
|---|---|---|---|---|---|
| | | Ex. 6 | Ex. 7 | Ex. 8 | Ex. 9 |
| oxidizing agent | potassium perchlorate | 25.0 | 40.0 | 45.0 | 42.0 |
| | ammonium perchlorate | 25.0 | | | |
| fuel | hemp coal | 2.3 | 1.6 | 3.0 | 2.1 |
| | Combustion agent BL | 6.0 | 5.0 | 7.6 | 6.5 |
| | chlorinated rubber | 8.0 | 5.0 | 7.0 | 6.5 |
| | phenolic resin | 1.6 | 0.9 | 2.5 | 1.5 |
| color producing agent | strontium carbonate | | 11.0 | 16.4 | |
| | sodium oxalate | | | | 21.4 |
| | copper oxide | | 11.0 | | |
| | barium nitrate | 15.1 | | | |
| color of flame | | green | purple | red | yellow |

Industrial Applicability

The pyrotechnic composition which is easily prepared and has the excellent effect as a firework composition can be obtained according to the present invention.

What is claimed is:

1. A pyrotechnic composition prepared by mixing nitrocellulose and a nitroalkane to prepare a composition in a gel form, mixing an oxidizing agent, a fuel and a color producing agent to the composition and then drying to remove the nitroalkane from the gel.

2. A pyrotechnic composition as claimed in claim 1 wherein the composition in the gel form comprises 3 to 40% by weight of nitrocellulose and 97 to 60% by weight of the nitroalkane.

3. A pyrotechnic composition as claimed in claim 1 or 2 wherein the content of nitrocellulose in the pyrotechnic composition is 0.6 to 12% by weight.

4. A pyrotechnic composition as claimed in claim 1 wherein the contents of the oxidizing agent, the fuel and the color producing agent are 40 to 60% by weight, 10 to 25% by weight and 15 to 50% by weight, respectively.

5. A pyrotechnic composition as claimed in claim 1 which is in the form of a star or a lance.

* * * * *